US005163408A

United States Patent [19]

Nemoto

[11] Patent Number: 5,163,408

[45] Date of Patent: Nov. 17, 1992

[54] ELECTRONIC FUEL INJECTION CONTROL DEVICE FOR INTERNAL COMBUSTION ENGINE AND METHOD THEREOF

[75] Inventor: Mamoru Nemoto, Katsuta, Japan

[73] Assignees: Hitachi Ltd., Tokyo; Hitachi Automotive Engineering Co., Ltd., Katsuta, both of Japan

[21] Appl. No.: 780,064

[22] Filed: Oct. 21, 1991

[30] Foreign Application Priority Data

Oct. 19, 1990 [JP] Japan ..... 2-279053

[51] Int. Cl.[5] ..... F02D 41/06

[52] U.S. Cl. ..... 123/491

[58] Field of Search ..... 123/478, 450, 491, 179.16

[56] References Cited

U.S. PATENT DOCUMENTS

| | | | |
|---|---|---|---|
| 4,705,004 | 11/1987 | Takahashi et al. | 123/491 |
| 4,844,039 | 7/1989 | Osaki et al. | 123/491 |
| 4,875,452 | 10/1989 | Hara et al. | 123/491 X |
| 5,027,779 | 7/1991 | Nishiyama | 123/491 |
| 5,092,301 | 3/1992 | Ostdiek | 123/491 X |

FOREIGN PATENT DOCUMENTS 0021816 5/1988 Japan .

*Primary Examiner*—Willis R. Wolfe

*Attorney, Agent, or Firm*—Antonelli, Terry, Stout & Kraus

[57] ABSTRACT

An electronic fuel injection device for an internal combustion engine, wherein operating conditions of the internal combustion engine is detected; a fuel injection value for the internal combustion engine is calculated based upon the detected operating conditions; the calculated fuel injection value is corrected by a fuel correction value during engine start which is stored in a memory; a fuel injection pulse for a fuel injector corresponding to the corrected fuel injection value during engine start is generated; a start time of the internal combustion engine started by the fuel injection determined by generated fuel injection pulse; a start time rank for the detected start time is assigned depending upon the length of the start time; a new fuel correction value is calculated by summing up variables of factors in Table 1 which influence the air/fuel ratio during engine start and are determined for every start time rank based upon the assigned start time rank; the fuel correction value used for the present engine start is renewed by adding the calculated new fuel correction value during engine start and is stored in the memory for use in the next engine start.

9 Claims, 12 Drawing Sheets

ELECTRONIC FUEL INJECTION CONTROL DEVICE FOR INTERNAL COMBUSTION ENGINE AND METHOD THEREOF

BACKGROUND OF THE INVENTION

The present invention relates to an electronic fuel injection control device for an internal combustion engine and method thereof in particular suitable for engine start control wherein a start time of the internal combustion engine which represents the air/fuel ratio during the engine start is detected and the detected start time is used for determining the amount of fuel to be injected in the next engine start for realizing an adaptive control.

The amount of fuel to be injected during start of the internal combustion engine in a conventional electronic fuel injection control device was determined by outputting a pulse having a fixed pulse width to fuel injectiors which is obtained without regarding the amount of air taken in the cylinders. Therefore the pulse having a fixed pulse width was corrected by assuming the intake air into the cylinders with the engine water temperature and engine rotating number and had to be set at a value which enabled engine start at all conditions.

In such conventional electronic fuel injection control device for an internal combustion engine, no influences with regard to scattering or non-uniformity of such as fuel injector and engine performance and difference of fuel nature such as heavy gasoline and light gasoline were taken into consideration such that air/fuel ratio during engine start scattered due to the above factors and there arised a problem that the start characteristics of internal combustion engine differed in every vehicle and every region where the vehicles were used.

JP-B-63-21816 (1988) discloses one solution of the above problem wherein it is experimentally proved that air/fuel ratio during engine start has a predetermined correlation with a time $T_1$ until initial explosion and a time $T_2$ from the initial explosion to a complete explosion which determines engine start time and at engine start a stored fuel correction value during engine start corresponding to a detected engine water temperature is retrieved and used for the engine start and time $T_1$ and time $T_2$ are also detected and these values are compared with the previous values for the same engine water temperature and the fuel correction value during engine start used for the present engine start is modified based upon the comparison result with reference to the proved correlation and is stored for the next engine start at the corresponding engine water temperature.

However, according to an experiment of the present inventor, with the control device indicated above, the engine start time scatters about 0.3 sec even in an optimum air/fuel ratio and when in a lean air/fuel ratio the scattering further increases. Still further, in the above control device when the time $T_1$ until initial explosion is long and the time $T_2$ until complete explosion is short, the air/fuel ratio during engine start is judged lean. However when fuel remains within the intake tube due to such as fuel leakage from the fuel injector the air/fuel ratio during engine start is rendered excess rich such that the initial explosion is never caused before the remaining fuel component is scavenged and approaches to a combustible air/fuel ratio. This indicates that there is an instance that the time $T_1$ until intial explosion is long and the time $T_2$ until complete explosion is short even if the air/fuel ratio during engine start is rich such that the above control device may erroneously determine air/fuel ratio during engine start.

The engine start time greatly varies depending upon the water temperature at engine start, because viscosity of the engine oil and the battery voltage are affected by the water temperature at engine start, for this reasons in the above control device great many sets of the time $T_1$, time $T_2$ and fuel correction value during engine start corresponding to respective water temperatures at engine start have to be stored in a RAM which necessitates increase of memory capacity in the control device.

SUMMARY OF THE INVENTION

The present invention is achieved in view of the problems in the above conventional art and an object of the present invention is to provide an electronic fuel injection control device for an internal combustion engine and a method thereof in which the scattering of the engine start time is eliminated, with a RAM having a small memory capacity a fuel correction value used for the next engine start is modified by making use of a detected engine start time representing the air/fuel ratio during the engine start and the fuel nature now used is determined by making use of the detected engine start time and the modified fuel correction value and is used for correcting air/fuel ratio after engine start to thereby maintain an optimum operating condition for the internal combustion engine.

For achieving the above object, in the electronic fuel injection control device for an internal combustion engine according to the present invention, a fuel injection value is calculated in a fuel injection value calcurating arrangement based upon engine operating conditions detected by an operating condition detecting arrangement. On the other hand, a start time detected by a start time detecting arrangement is classified and assigned a start time rank by a start time rank judgement arrangement, a fuel correction value is calculated in a fuel correction value calculating arrangement in dependent upon the assigned start time rank, a previous fuel correction value stored in a memory is modified and renewed by a renewal arrangement and the renewed fuel correction value is used for correcting a fuel injection value via a correction arrangement during next engine start operation.

Further, according to the present invention, by making use of the determined start time rank and the renewed fuel correction value in a fuel nature determination arrangement nature of the fuel now used is determined, after the engine start a fuel injection value is corrected based upon the determined fuel nature and a width of fuel injection pulse is determined by the corrected fuel injection value in a fuel injection pulse generation arrangement.

According to the electronic fuel injection control device for an internal combustion engine according to the present invention, when making use of the start time which represents the air/fuel ratio during start of the internal combustion engine, the problem that the start time scatters even in a same air/fuel ratio during engine start is compensated by providing a predetermined time range for the respective start time ranks which are determined by classifying the start times and further, respective factors which influence to the air/fuel ratio during engine start in the respective start time ranks are expressed by variables such that accurate air/fuel ratio correction during engine start is realized.

Accordingly, with the electronic fuel injection control device for an internal combustion engine of the present invention, a stable engine start characteristic and a desirable vehicle operability after engine start are always obtained regardless to the scattering of fuel injector and engine performance and the difference of fuel nature now used.

DETAILED EXPLANATION OF THE EMBODIMENT

Hereinbelow, an embodiment of the present invention is explained with reference to the drawings.

Figure 1:
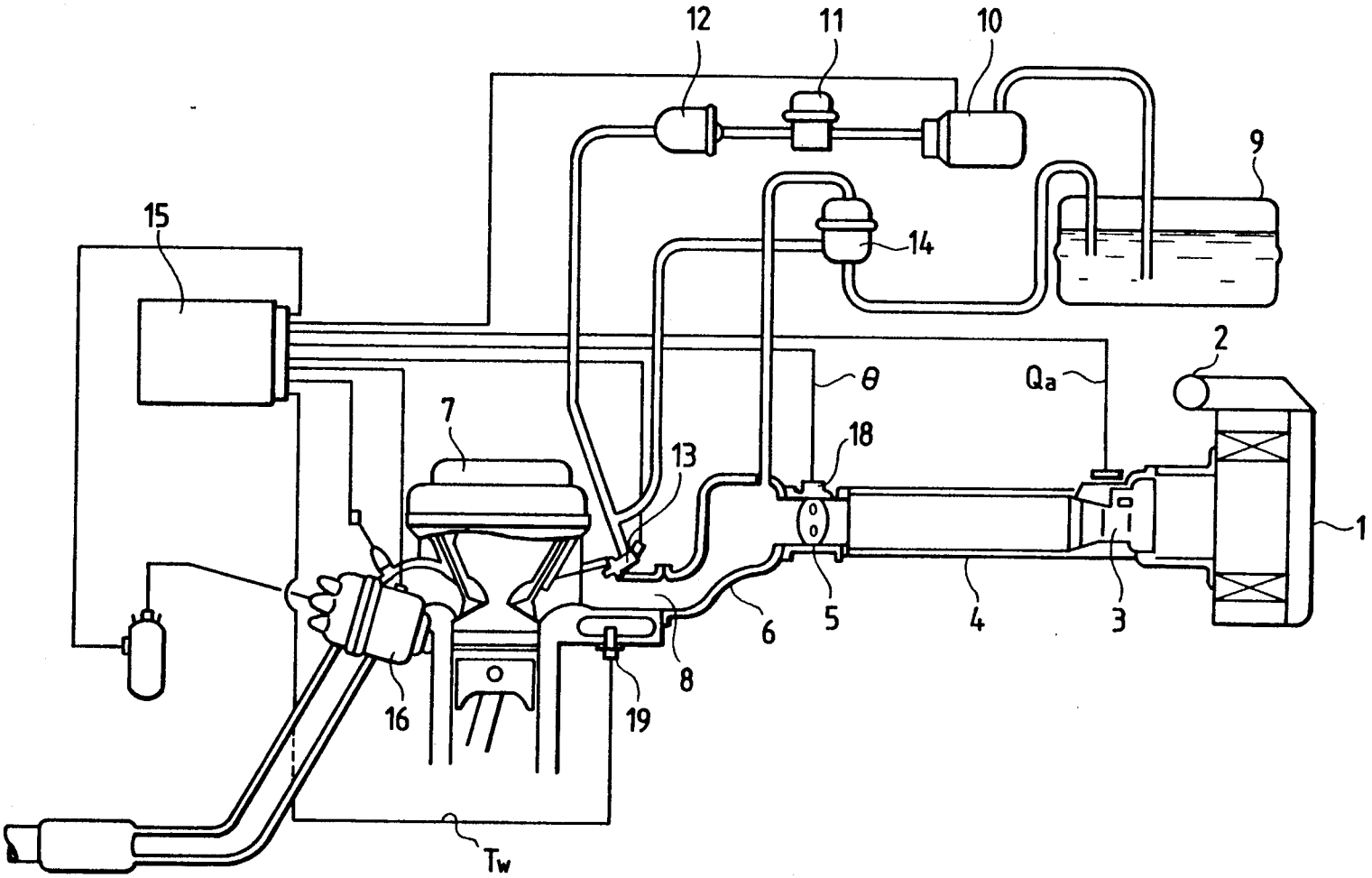
FIG. 1 is a schematic overview of an internal combustion engine system which includes an electronic fuel injection control device according to the present invention.

FIG. 1 is a schematic overview of an internal combustion engine system which includes an embodiment of the electronic fuel injection control device according to the present invention. In the drawing, intake air to an engine main body 7 is introduced from an inlet port 2 of an air cleaner 1 and is carried into a collector 6 via a hot wire type air flow meter 3 which detects the intake air flow rate, a duct 4 and a throttle body 5 incorporating throttle valve which controls air flow rate. In the collector 6, the air is divided into respective intake pipes 8 which communicate to the engine 7 and is charged into the respective cylinders. Fuel, on one hand, is pumped up from a fuel tank 9 and is pressurized by a fuel pump 10, thereafter the fuel passes through a fuel damper 11 and a fuel filter 12 and is finally injected from injectors 13 provided within the respective intake pipes 8. On the other hand, signals representing operating conditions of the engine 7 such as output signals $Q_a$ from the hot wire type air flow meter 3, output signals $T_w$ from a water temperature sensor 19 which is attached to the engine 7 for detecting the temperature thereof, output signals from a crank angle sensor which is built-in in a distributor 16 for detecting engine rotating number and output signals $\theta$ from a throttle sensor 18 which is incorporated in the throttle body for detecting the opening degree of the throttle sensor 18 are input into a control unit 15.

The control unit 15 calculates a fuel injection value and realizes the fuel injection value by regulating the valve opening time of the injectors.

Figure 2:
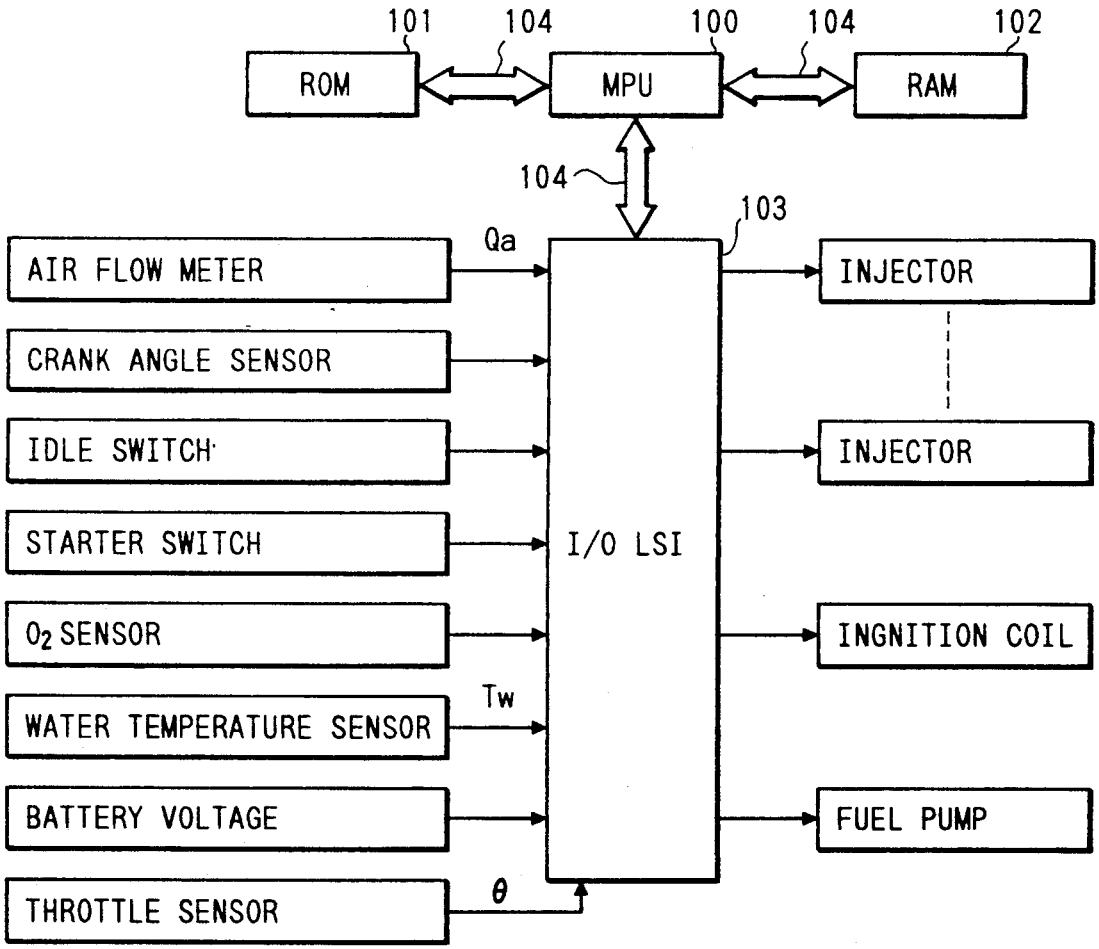
FIG. 2 is a block diagram of a control unit shown in FIG. 1.

FIG. 2 shows an internal structure of the control unit 15 wherein an MPU 100 processes fuel injection values and ignition timings based upon several kinds of input signals sent from an I/O LSI 103 connected through a bus 104 and is also connected via a bus 104 to a ROM 101 in which processing sequence and fixed information necessary for the processing are stored. Further, a RAM 102 is a read/writable LSI which stores several kinds of information processed in the MPU 100 and to which electric power is always supplied even if the ignition key is turned off for holding the memory content therein. The I/O LSI 103 builts in an A/D converter through which analogue signals from the hot wire type air flow meter 3, an $O_2$ sensor, the water temperature sensor 19, a battery voltage detector and the throttle sensor 18 are converted into digital signals and are sent to the MPU 100. Further the ON-OFF signals from the crank angle sensor, an idle switch and starter switch are also processed in the I/O LSI 103. On the other hand, the I/O LSI serves to receive fuel injection information processed in the MPU 100 and to send valve opening signals to the injectors 13.

Now, the operation of the electronic fuel injection control device according to the present invention is explained with reference to FIG. 3. In a vehicle operating condition detecting arrangement S1, operating conditions of the internal combustion engine 7 are detected by processing the input signals from the above mentioned several kinds of sensors. An injection value calculating arrangement S2 calculates fuel injection value fed to the respective cylinders of the engine 7 via the fuel injectors 13 with reference to a predetermined arthmetic equation based upon the operating conditions of the internal combustion engine detected in the above arrangement. The fuel injection values calculated in the fuel injection value calculating arrangement S2 are corrected in a correcting arrangement S3 by correction values such as from a memory details of which will be explained later, thereafter the corrected values from the correcting arrangement S3 are converted to pulse signals for opening valves in the fuel injectors 13 in a fuel injection pulse generating arrangement S4 and are supplied to the fuel injectors.

Figure 4:
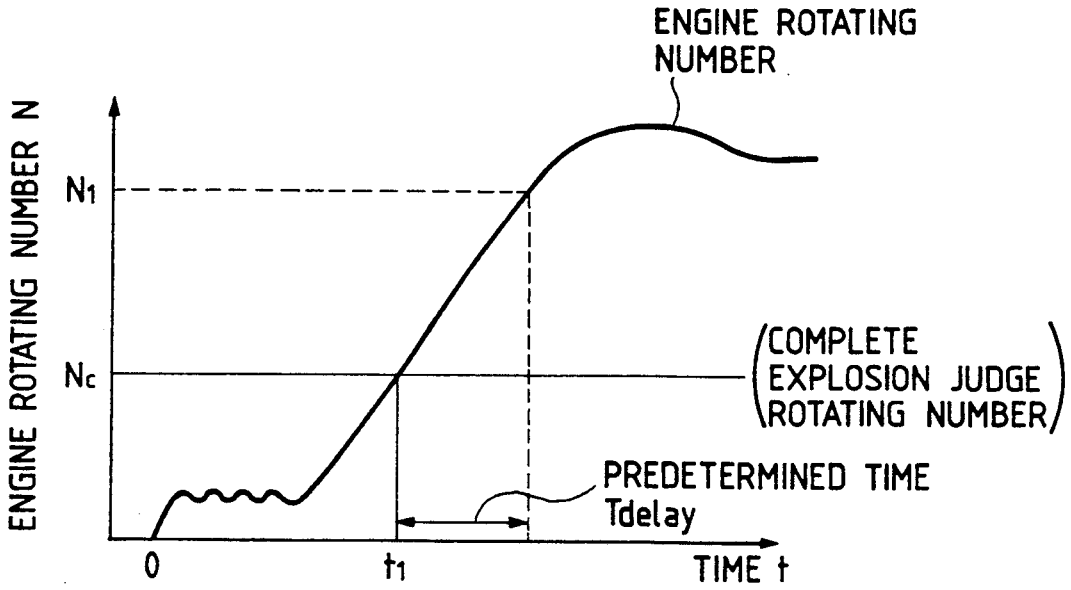
FIGS. 4 and 5 are graphs showing relationships between engine rotating number and time during engine start for determining engine start time.
Figure 5:
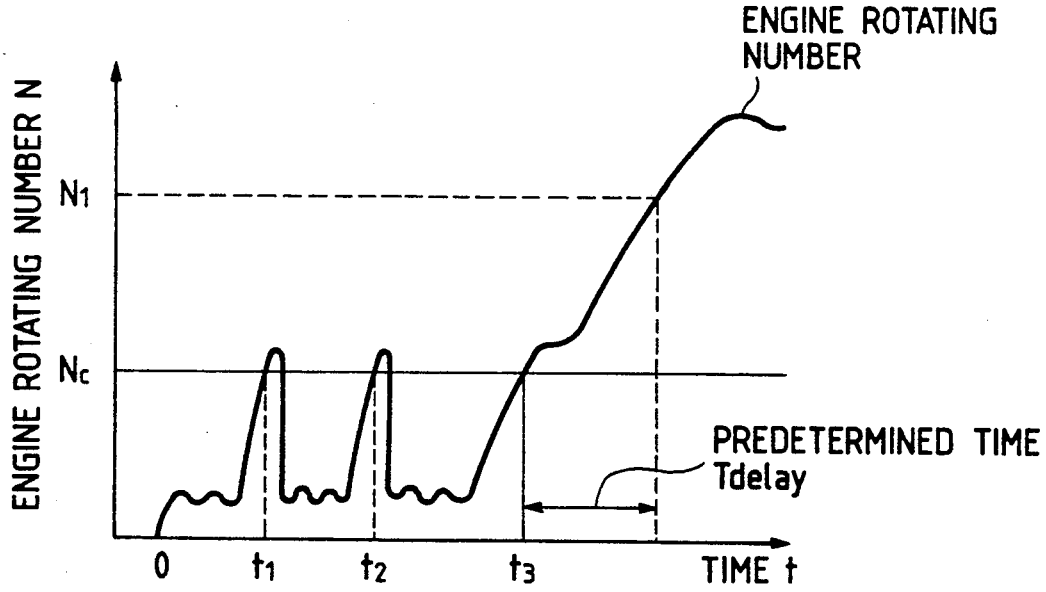
Figure 6:
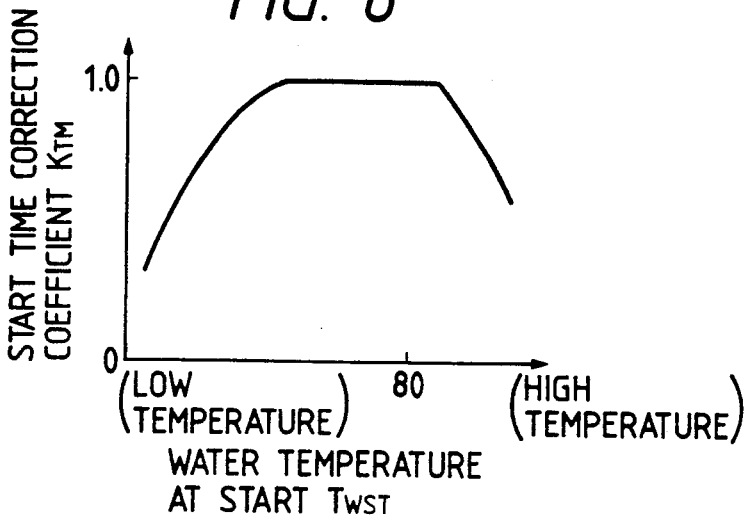
FIG. 6 is a graph showing a relationship between engine start time correction coefficient $K_{TM}$ and water temperature at engine start used in the present invention.
Figure 7:
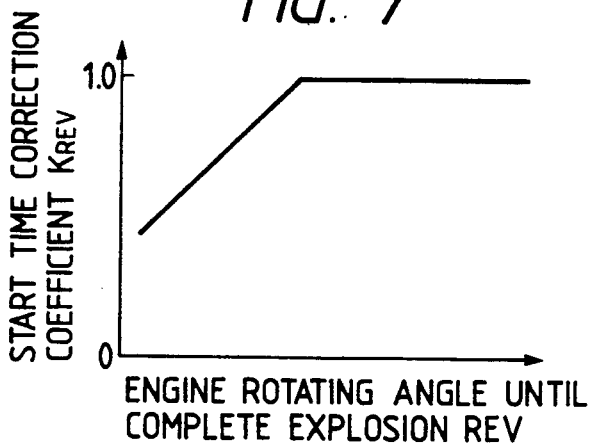
FIG. 7 is a graph showing a relationship between engine start time correction coefficient $K_{REV}$ and engine rotating angle until complete fuel explosion used in the present invention.

On the other hand, in an engine start time detecting arrangement S5, the start time of the engine 7 is obtained with reference to a complete explosion judge rotating number $N_C$ and a predetermined time $T_{delay}$ as a shown in FIG. 4. The complete explosion judge rotating number $N_C$ is set at a value wherein the engine 7 can rotate by itself without help of a starter motor. In this arrangement, time $t_1$ at which the engine rotating during start thereof exceeds the complete explosion judge rotating number $N_C$ is stored, and after the predetermined time $T_{delay}$ has passed the engine rotating number still remains above the complete explosion judge rotating number $N_C$, the arrangement judges a complete explosion and determines the stored time $t_1$ as the start time, this predetermined time $T_{delay}$ is used for preventing erroneous detection of the start time such as erroneously determining $t_1$ or $t_2$ as the start time when the engine rotating number incidentally exceeds the complete explosion judge rotating number $N_C$ at the initial explosion as shown in FIG. 5 in which instance $t_3$ is the start time. The detected start time is standardized by multipling a start time correction coefficient $K_{TM}$ which is obtained based on the water temperature $T_{WST}$ at engine start period as shown in FIG. 6, in other words, variation of the start time depending upon the water temperature at engine start period is compensated. The start time is further multiplied by another start time correction coefficient $K_{REV}$ which is obtained based on the engine rotating angle until complete explosion REV as shown in FIG. 7 in order to compensate a prolonged start time due to reduction of cranking rotating number caused by battery voltage reduction. In other words, the start time is further standardized depending upon number of fuel feed times represented by the engine rotating angle until complete explosion indicated by abscissa on the coordinate shown in FIG. 7. As a result, a standard start time $S_{time}$ time is obtained.

Figure 8:
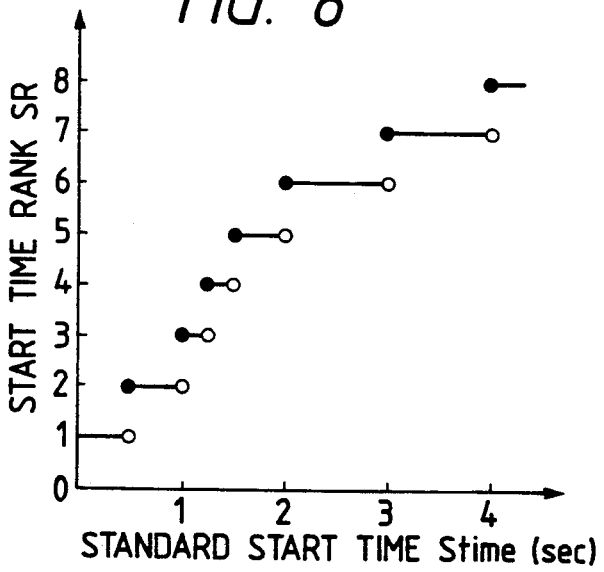
FIG. 8 is a graph showing a relationship between start time rank SR and standard start time used in the present invention.

Subsequently, in a start time rank judging arrangement S6, a start time rank is determined based on the resultant standard start time with reference to the relationship between start time rank and standard start time as shown in FIG. 8. A problem that the standard start time is prolonged and scatters when air/fuel ratio during start is lean is solved by lengthening the standard start time bands depending upon increase of the start time rank as shown in FIG. 8.

In a correction value calculating arrangement S7, a correction value is calculated depending upon an obtained start time rank representing a standard start time. Wherein major factors such as shown in Table 1 which influence the start time rank are expressed by variables as a function of the start time rank in view of their influences.

TABLE 1

| factor | start time rank 1 | 2 | 3 | 4 | 5 | 6 | 7 | 8 |
|---|---|---|---|---|---|---|---|---|
| $INJ_L$ injector flow rate− | 0 | 0 | 0.01 | 0.03 | 0.03 | 0.03 | 0.03 | 0.03 |
| $INJ_R$ injector flow rate+ | −0.03 | −0.01 | 0 | 0 | 0 | 0 | 0 | 0 |
| POI injector clogging | 0 | 0 | 0 | 0 | 0.02 | 0.04 | 0.04 | 0.05 |
| LEAK fuel leakage | 0 | 0 | 0 | 0 | −0.11 | −0.15 | −0.17 | −0.17 |
| HGAS heavy gasoline | 0 | 0 | 0 | 0.02 | 0.05 | 0.05 | 0.07 | 0.08 |
| LGAS light gasoline | −0.05 | −0.02 | 0 | 0 | 0 | 0 | 0 | 0 |
| total correction coefficient | −0.08 | −0.03 | 0.01 | 0.05 | 0.1 (−0.01) | 0.12 (−0.03) | 0.14 (−0.03) | 0.16 (−0.01) |

The respective variables for correction for the respective factors are determined so that an optimum air/fuel ratio at start period is approached, in other words the respective variables are set so that the standard start time of the vehicle finally converges to that corresponds to start time rank 2 or 3. In this arrangement, sum of the variables of the respective factors is calculated based upon the obtained start time rank.

The major factors which are incorporated for determining the correction value during start period and some variables thereof are explained. Flow rate scattering in fuel injectors, which is determined during production, is one of the factors which determines the standard start time, in that start time rank, when expressing the factor of a fuel injector having a less flow rate by $INJ_L$ and considering the influence of this factor $INJ_L$ on the engine starting characteristic, and assuming that the air/fuel ratio during engine start period is lean, the start time is prolonged such that a positive correction value 1% (0.01) is assigned for start time rank 3 and 3% (0.03) for start time rank 4 so that the amount of fuel at the next start period is corrected to increase. On the other hand, expressing the factor of a fuel injector having a much flow rate by $INJ_R$ and considering the influence of this factor $INJ_R$ on the engine starting characteristic, and assuming that the air/fuel ratio during engine start period is rich, the start time is shortened such that a negative correction value −3% (−0.03) is assigned for start time rank 1 and −1% (−0.01) for start time rank 2. With respect to a factor POI relating to clogging of the fuel injectors which decreases flow rate of fuel, when the degree of clogging of the fuel injector increases, the amount of fuel supply decreases and the air/fuel ratio at the engine start becomes lean so that a larger positive correction value is assigned depending upon the increase of start time rank as indicated in Table 1. In addition thereto other influential factors relating to fuel leakage from fuel injectors, heavy gasoline and light gasoline are also incorporated as LEAK, HGAS and LGAS as shown in Table 1.

The substantial influence of the factor LEAK is found out to appear at a water temperature range 50°-75° C. at engine start so that the factor LEAK is rendered active only during the above temperature range.

Figure 9:
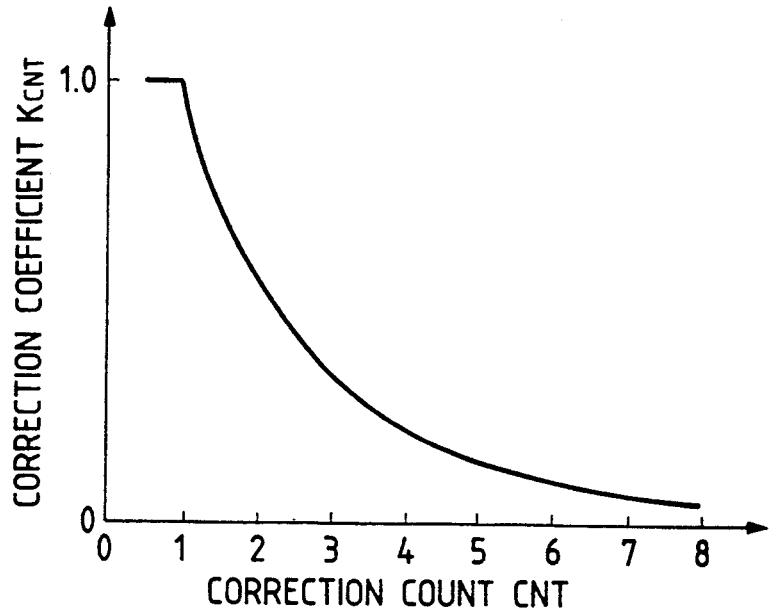
FIG. 9 is a graph showing a relationship between correction coefficient $K_{CNT}$ and correction count used in the present invention.

A total correction coefficient $K_{sum}$ obtained by summing up the respective variables relating to the influential factors depending upon the obtained start time rank is further multiplied by a correction coefficient $K_{CNT}$ which is determined by correction count CNT as shown in FIG. 9. The correction coefficients $K_{CNT}$ are determined so that the values thereof decrease depending upon increase of the correction count to thereby prevent over compensation.

After the above operation, a start pulse correction values $K_{START}$ for the next engine start period is finally calculated in accordance with the following equation by making use of the correction value actually used for the present engine start period $K_{START(used)}$ and $K_{sum} \times K_{CNT}$, $K_{START} = K_{START(used)} + K_{sum} \times K_{CNT}$.

The start pulse correction value $K_{START}$ which has been stored in a memory S9 and has been used for the present engine start period is renewed by the newest start pulse correction value thus calculated via a renewal arrangement S8 for use in the next engine start. Subsequently, in a fuel nature determination arrangement S10, the fuel nature whether heavy gasoline or light gasoline is used is determined with reference to a map defined by the start time rank and the start pulse correction coefficient $K_{START}$ obtained as above. Since heavy gasoline is hard to evaporate when compared to light gasoline, the rate of contribution to combustion is small and the artifical air/fuel ratio becomes lean to thereby prolong the engine start time. When the engine start time is prolonged the start time rank is raised such that the start pulse correction coefficient $K_{START}$ must have been corrected to a larger value. Accordingly, a region defined by high start time ranks and large start pulse correction coefficient $K_{START}$ indicates that the gasoline used is heavy gasoline. However, for preventing erroneous judgement, the determination is used for control after a predetermined number of the same judgements has been confirmed. When the gasoline is determined to be heavy gasoline in the fuel nature determination arrangement S10, the fuel injection value during the vehicle operation after the start period is corrected by the correction arrangement S3 so as to increase the fuel amount to thereby optimize the air/fuel ratio which contributes combustion and to stabilize the engine operation. On the other hand, the gasoline used is determined to be light gasoline, the opposite correction to the above is performed.

Through these adaptive controls, the deterioration of engine start characteristic due to scattering of engine performance and fuel injector flow rate which are determined during production and use of heavy gasoline are compensated to thereby obtain stable operating characteristics during and after engine start.

Figure 3:
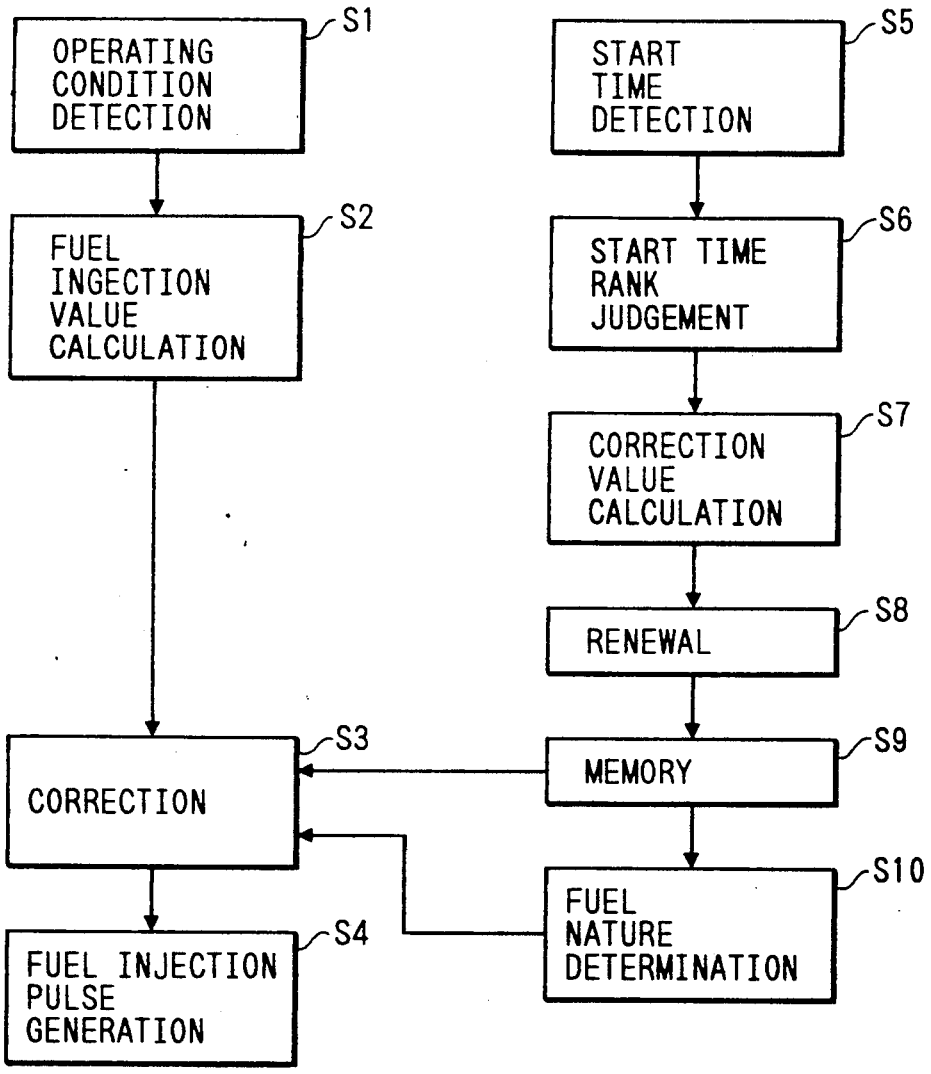
FIG. 3 is a block diagram for explaining the outline operation of the present invention.

FIGS. 11-16 are flow charts showing further details in the respective arrangements shown in FIG. 3.

Figure 11:
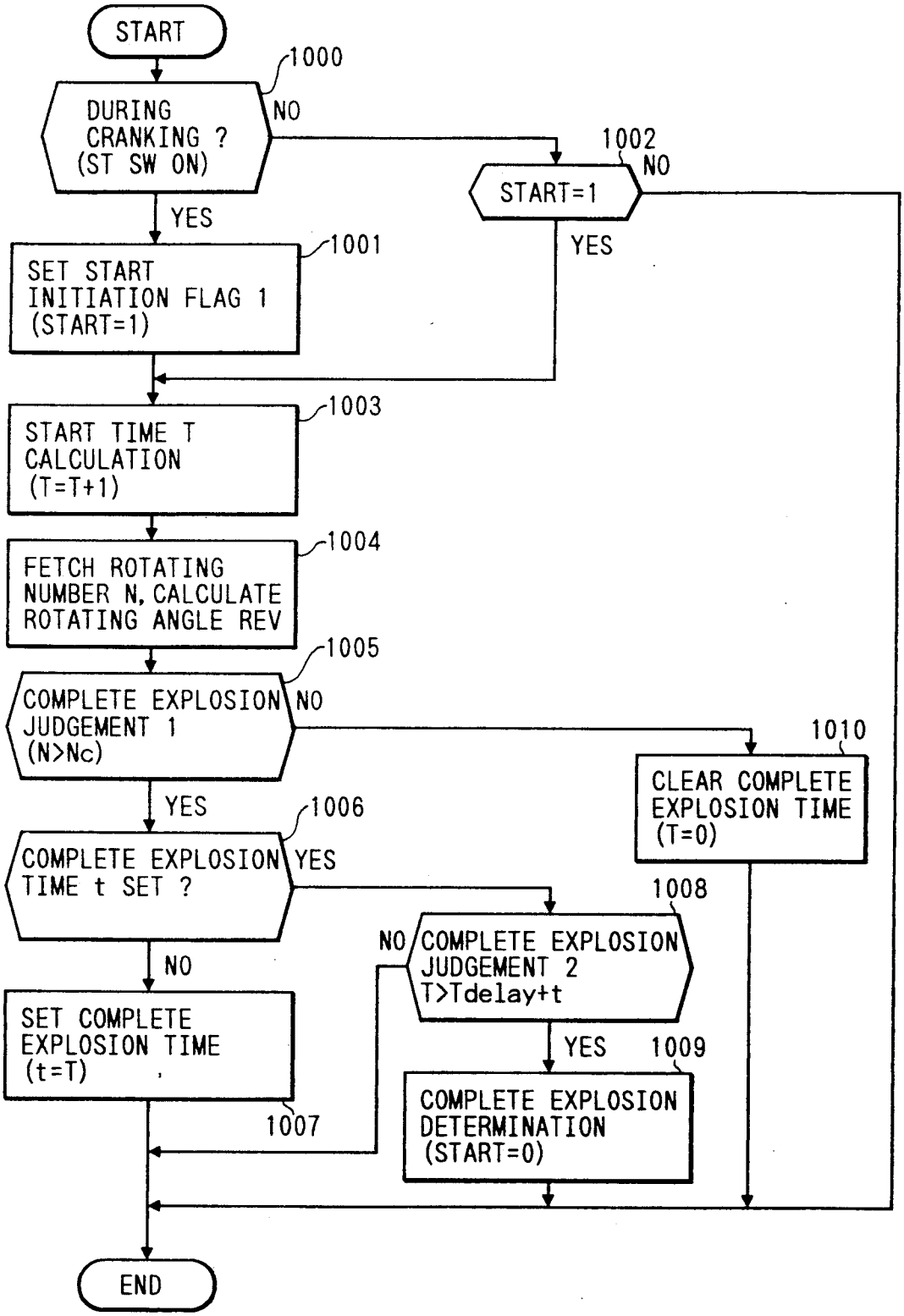
FIG. 11 is a flow chart showing details of the start time detecting operation in the block diagram shown in FIG. 3.

FIG. 11 shows a flow chart in the start time detection arrangement S5 in FIG. 3 which is initiated in every predetermined time. In step 1000, it is confirmed whether or not the cranking is initiated by the ON-OFF signals from the starter switch. When the starter switch is ON, it is confirmed that the cranking is initiated and the process proceeds to step 1001. In the step 1001, a start initiation flag START is set "1" which indicates that the present state is start mode. The start initiation flag is maintained "1" until complete explosion is judged at step 1009, thereby at the initiation of this routine in next time the start initiation flag in the step 1002 is checked even if the starter switch is OFF and when the start initiation flag is "1" the process proceeds to step 1003 the same processing routine as when the starter switch is ON such that the complete explosion judgement by means of the ON-OFF signals from the starter switch is prevented. Thereafter, in step 1003 the engine start time T is calculated. Since the present routine is initiated in every predetermined time, in this step a method of incrementing T is used.

Subsequently, the process proceeds to step 1004 wherein the engine rotating number N and engine rotating angle REV are calculated. Thereafter the process proceeds to step 1005 wherein it is checked whether the present engine rotating number N exceeds the complete explosion judge rotating number $N_C$. Depending upon the check result, when the engine rotating number N exceeds the complete explosion judge rotating number $N_C$, the process proceeds to step 1006, and when complete explosion time t is not set, the time T until now is set for the complete explosion time t in step 1007 and the process ends. On the other hand, the complete explosion time has been set in step 1006, the process proceeds to step 1008 and it is checked whether the time after the present engine rotating number N exceeds the complete explosion judge rotating number $N_C$ has passed over the predetermined time $T_{delay}$ and if the time has passed over the predetermined time $T_{delay}$, the process proceeds to step 1009 and wherein the complete explosion is determined and the start initiation flag START is reset to "0". Afterward, when the present routine is initiated, it is determined No in the step 1002, no processes below the step 1003 are carried out, the complete explosion time t is maintained until the engine stops. When the present engine rotating number N does not exceed the complete explosion judge rotating number $N_C$, the process proceeds to step 1010 wherein the complete explosion time $t_1$ or $t_2$ as shown in FIG. 5 if set is cleared for waiting next complete explosion time for example $t_3$ in FIG. 5.

Figure 12:
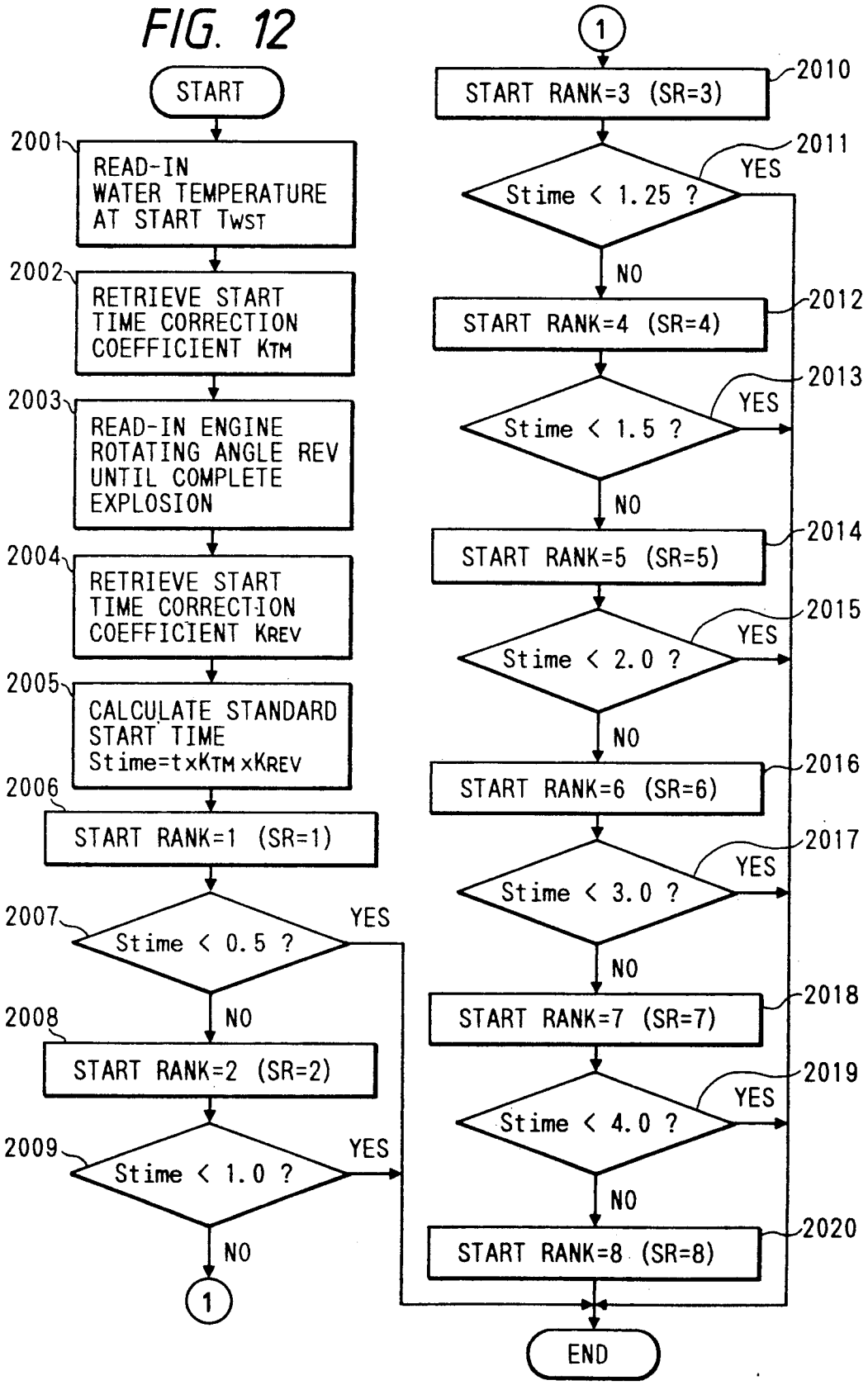
FIG. 12 is a flow chart showing details of the start rank judging operation in the block diagram shown in FIG. 3.

FIG. 12 shows a flow chart in the start time rank judgement arrangement S6 which is executed once after complete explosion judgement. At first, in step 2002, the start time correction coefficient $K_{TM}$ as shown in FIG. 6 is retrieved. For the retrieval of the start time correction coefficient $K_{TM}$ the deta shown in FIG. 6 are arranged in a form of table and stored in the ROM. Subsequently the process proceeds to step 2003 wherein the engine rotating angle REV until complete explosion is read-in. The read-in of the engine rotating angle REV is carried out by making use of the calculation result in the step 1004 in FIG. 11. Subsequently, in step 2004, another start time rotation correction coefficient $K_{REV}$ is retrieved of which calculation is carried out with reference to the tabulated data shown in FIG. 7 with the similar method as in the retrieval of $K_{TM}$. Thereafter, in step 2005, the standard start time $S_{time}$ is obtained which is calculated by multiplying the complete explosion time t obtained in the step 1007 in FIG. 11 by the start time correction coefficients $K_{TM}$ and $K_{REV}$. Steps after step 2006 are a routine for calculating the start time rank which makes use of the relationship shown in FIG. 8. At first, in the step 2006, the start time rank SR is assumed as 1, and when the standard time $S_{time}$ is confirmed below 0.5 sec in step 2007 the routine under consideration ends and the start time rank SR is determined as 1. If the step 2007 shows No, the start time rank SR is assumed as 2 in step 2008 and when the standard start time $S_{time}$ is confirmed below 1.0 sec in step 2009 the present routine ends and the start time rank SR is determined as 2.

The same processes are repeated thereafter until step 2020 in order to determine the start time rank. The standard times 0.5, 1.0, 1.25, 1.5, 2.0, 3.0 and 4.0 sec. for the respective start time ranks exemplified in the steps 2007, 2009, 2011, 2013, 2015, 2017 and 2019 vary depending upon engine characteristics such as configuration of the combustion chamber, position of spark plugs and presence or absence of a swirl, such that these values have to be experimentally obtained on respective types of engines.

Figure 13:
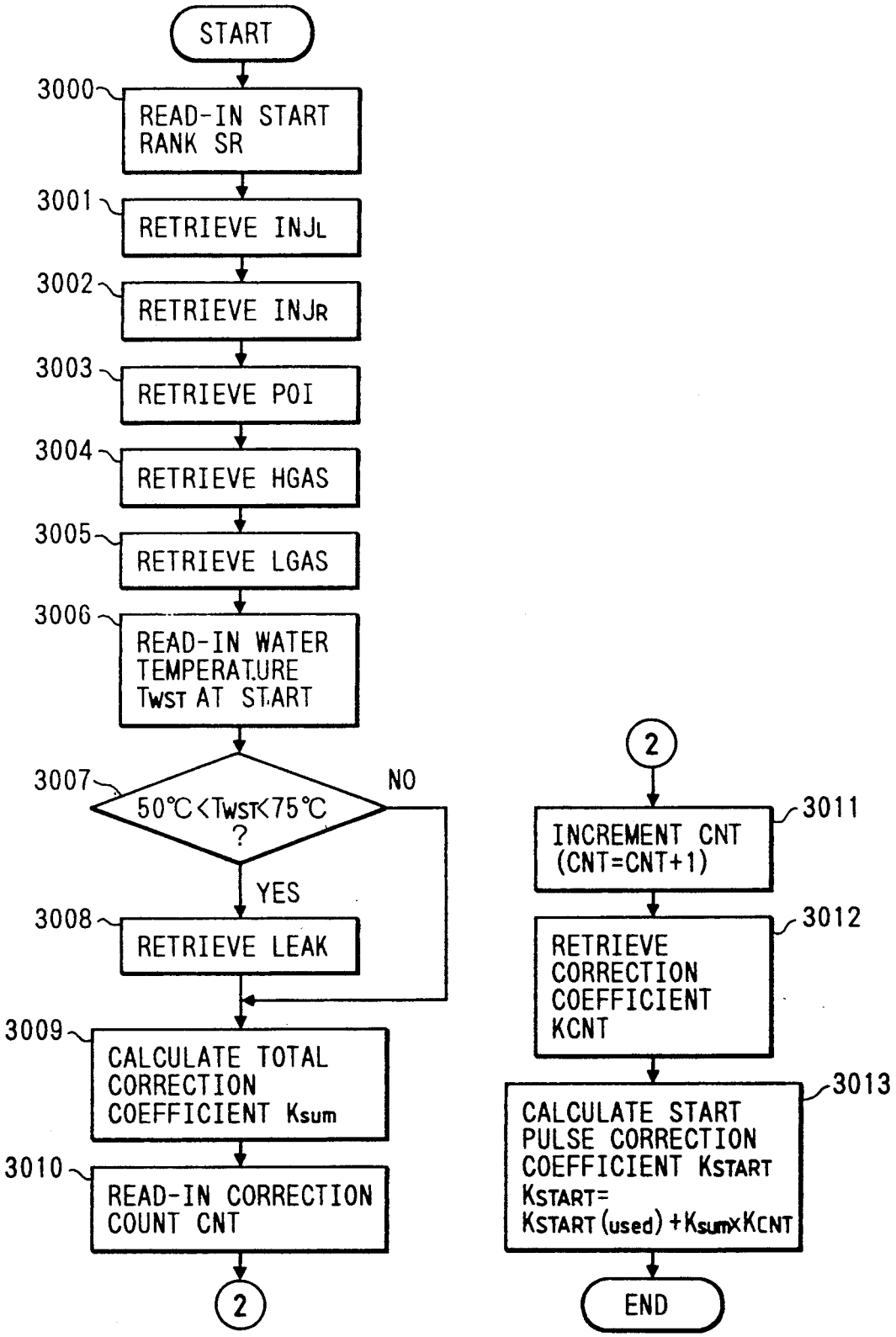
FIG. 13 is a flow chart showing details of the correction amount calculating operation in the block diagram shown in FIG. 3.

FIG. 13 shows a routine for calculating the start pulse correction coefficient $K_{START}$ in the correction value calculation arrangement S7 shown in FIG. 3 based upon the start time rank SR obtained in the process in FIG. 12. At first, in step 3000, the determined start time rank is read-in. In steps from 3001 to 3005, the respective variables of the factors $INJ_L$, $INJ_R$, POI, HGAS and LGAS are retrieved based upon Table 1, subsequently, the process proceeds to step 3006 wherein the water temperature $T_{WST}$ at engine start is read-in which is used for evaluating the influence of the fuel leakage from the fuel injectors and when the water temperature $T_{WST}$ is determined between 50° C. and 75° C. in step 3007 the process proceeds to step 3008 and the variables of the factor LEAK depending upon the determined start time rank is retrieved with reference to Table 1. In the step 3007 the answer is No, no calculation is performed with regard to the factor LEAK and the process proceeds to step 3009, wherein the respective variables retrieved with regard to the factors from $INJ_L$ to LEAK are summed up to obtain a total correction coefficient $K_{sum}$. This total correction coefficient $K_{sum}$ thus obtained is used for correcting a fuel amount which is fed during next starting period.

Steps 3010–3012 are introduced for preventing over compensation by the total correction coefficient $K_{sum}$. At first, in the step 3010 the correction count CNT until now is read-in wherein the initial value is 0. By incrementing the correction count CNT in the next step 3011 it is recognized how many times the total correction coefficient $K_{sum}$, actually the start pulse correction coefficient $K_{START}$, has been corrected. In the step 3012, the correction coefficient $K_{CNT}$ is retrieved with reference to the relationship shown in FIG. 9 and in step 3013 a start pulse correction coefficient $K_{START}$ of the fuel amount for the next start period is calculated and thereafter the present routine ends.

Figure 10:
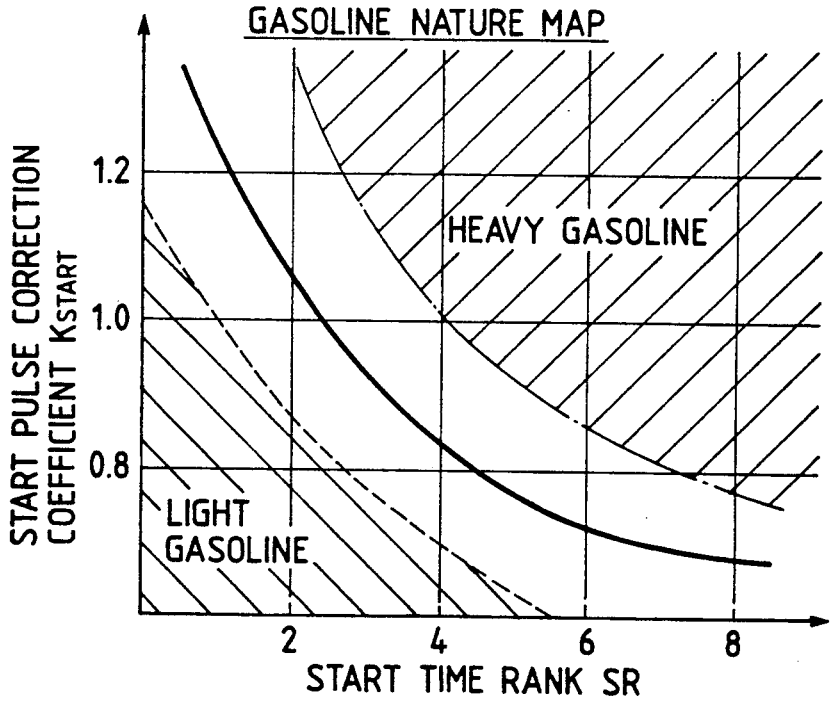
FIG. 10 is a gasoline nature determining map used in the present invention which is defined by a relationship between start pulse correction coefficient $K_{START}$ and start time rank.
Figure 14:
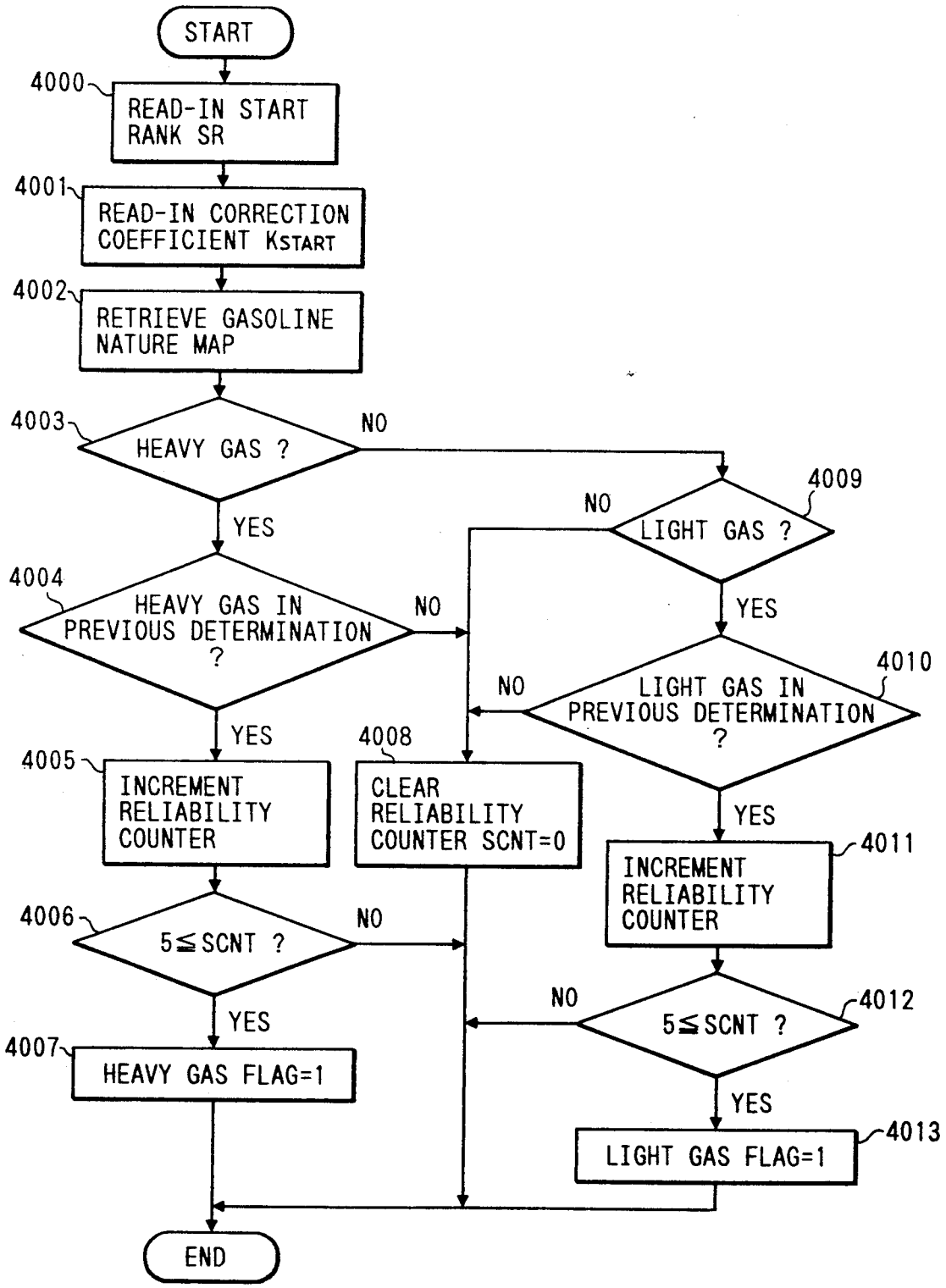
FIG. 14 is a flow chart showing details of the fuel nature determining operation in the block diagram shown in FIG. 3.

FIG. 14 shows a routine for determining the gasoline nature used which corresponds to the fuel nature determination arrangement S10 in FIG. 3 by making use of the determined start time rank SR and start pulse correction coefficient $K_{START}$, wherein in steps 4000 and 4001 the respective start time rank SR and start pulse correction coefficient $K_{START}$ are read-in. Subsequently, in step 4002 the nature of the gasoline used is judged based upon these two data with reference to the gasoline nature map illustrated in FIG. 10. In step 4003, based upon the judgement result, when the gasoline used is heavy gasoline the process proceeds to step 4004 and if not the process proceeds to step 4009.

The steps below the step 4004 and step 4009 are for enhancing reliability of the above judgement wherein after the same judgement result is repeated by a predetermined times the judgement is applied for the control. At first, in step 4004, it is checked whether the previous judgement is heavy gasoline and if yes the process proceeds to step 4005 to increment a reliability counter SCNT. Subsequently, in step 4006, the reliability counter shows more than 5, a heavy gasoline flag is set to "1" in step 4007 and it is determined that the gasoline now used is heavy gasoline. On the other hand, in the step 4004, the previous judgement is not heavy gasoline such shows that the judgement with regard to gasoline nature is inverted therefore the reliability of the judgement result is treated as low, and the process proceeds to step 4008 wherein the reliability counter SCNT is reset to "0" and the present routine ends. The steps below the step 4009 relate to light gasoline, the equivalent process as for the heavy gasoline is taken for the light gasoline, therefore detail explanation thereof is omitted.

Figure 15:
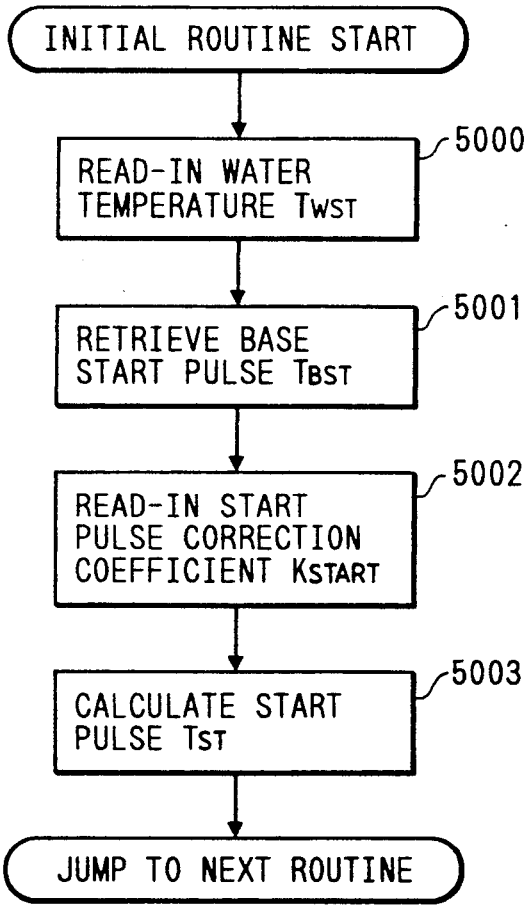
FIG. 15 is a flow chart showing details of the operating condition detecting, fuel injection calculating, correcting the same and fuel injection pulse generating operations during engine start period in the block diagram shown in FIG. 3.

FIG. 15 shows a flow chart wherein the start pulse correction coefficient $K_{START}$ obtained in the routine explained in connection with FIG. 13 is actually reflected in the start pulse at the next start period, wherein step 5000 and 5001 have been used in a conventional start pulse calculation routine.

At first, in step 5000, the water temperature of the engine before the start is read-in, based upon the read-in a data base start pulse $T_{BST}$ is retrieved. This base start pulse $T_{BST}$ is tabulated as a function of the water temperature, and as the lower the water temperature the larger the base start pulse value $T_{BST}$ is set. Subsequently, in step 5002 a start pulse correction coefficient $K_{START}$ is read-in and in step 5003 a start pulse $T_{ST}$ is calculated which is a product of the base start pulse $T_{BST}$ and the start pulse correction coefficient $K_{START}$. This start pulse $T_{ST}$ represents a driving pulse width for the fuel injectors and through the I/O LSI 103 shown in FIG. 2 a predetermined voltage is applied to the fuel injectors for the time corresponding to the duration of the start pulse $T_{ST}$ to supply fuel into the engine.

Figure 16:
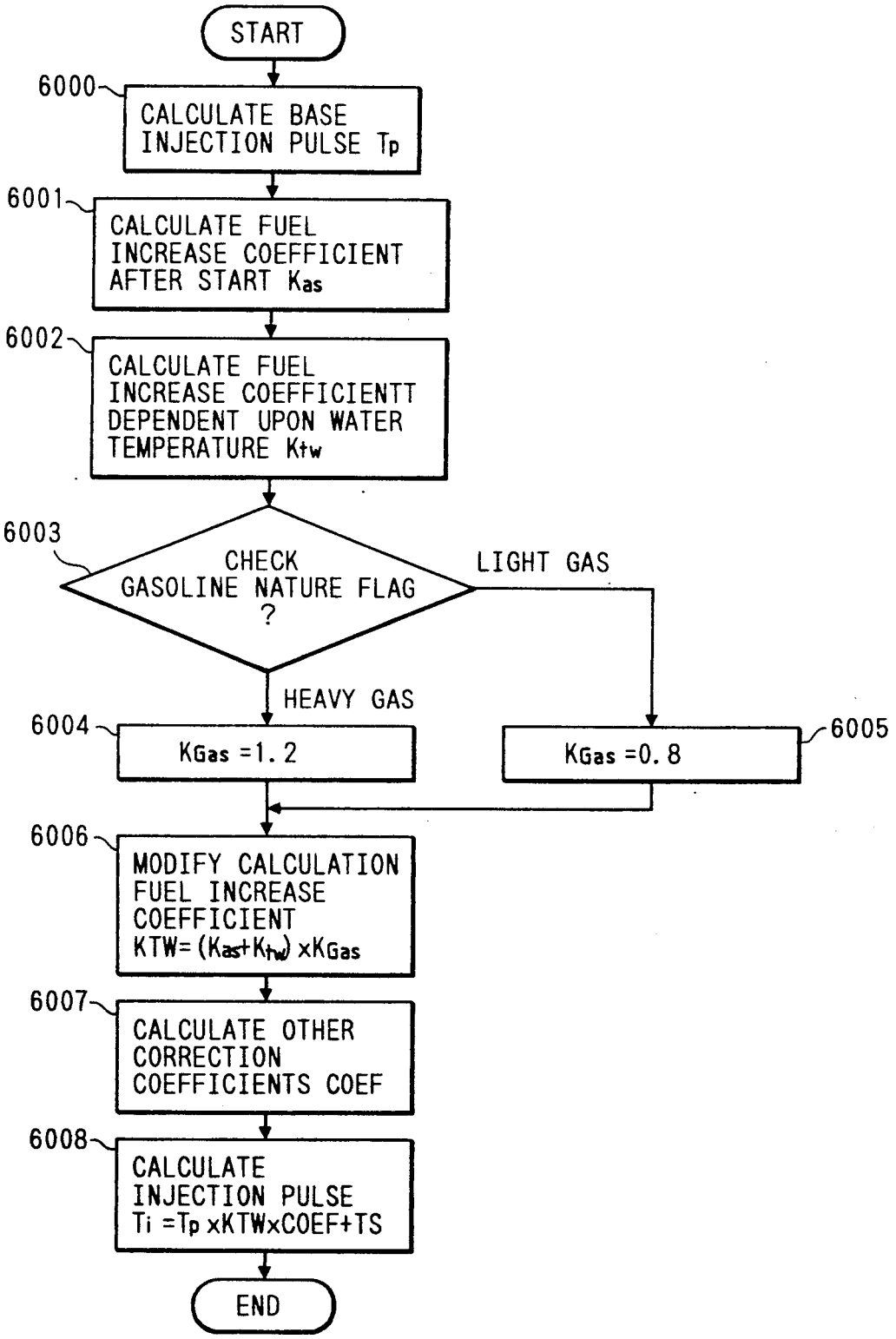
FIG. 16 is a flow chart showing details of the operating condition detecting, fuel injection calculating, correcting the same and fuel injection pulse generating operations after engine start period based on the fuel nature determination in the block diagram shown in FIG. 3.

FIG. 16 shows a routine performed after engine start for maintaining an optimum combustion condition by correcting a fuel supply amount into increasing or decreasing direction based on the gasoline nature determined in the routine shown in FIG. 14.

Steps from step 6000 to step 6002 are a conventional routine wherein an injection pulse width during a normal operating condition is determined, in that, in the step 6000 a base injection pulse $T_P$ is calculated, subsequently in the step 6001 a fuel increase coefficient after start $K_{as}$ is calculated then in the step 6002 a fuel increase dependent upon water temperature $K_{tw}$ is calculated. Thereafter, in step 6003 the gasoline nature flag which has been determined in the routine shown in FIG. 14 is checked, when the gasoline used is heavy gasoline as the result of the check, the process proceeds to step 6004 wherein an injection pulse correction coefficient $K_{Gas}=1.2$ is determined so as to increase the amount of fuel. Contrary, when the check result in the step 6003 indicates that the gasoline used is light gasoline, the process proceeds to step 6005 wherein an injection pulse correction coefficient $K_{GAS}=0.8$ is determined so as to decrease the amount of fuel. The correction of fuel amount depending upon the nature of gasoline used is specifically achieved by incorporating the injection pulse correction coefficient $K_{Gas}$ into a fuel increase coefficient KTW in the next step 6006. In step 6007, the other several kinds of correction coefficients COEF are calculated, and in step 6008 an injection pulse width $T_i$ is calculated based upon the arthmetic equation shown.

I claim:

1. An electronic fuel injection control device for an internal combustion engine comprising:

means for detecting operating conditions of the internal combustion engine;

means for calculating a fuel injection value for the internal combustion engine based upon the detected operating conditions by said operating condition detecting means;

means for correcting the calculated fuel injection value by a fuel correction value during engine start which is stored in a memory;

means for generating fuel injection pulse for a fuel injector corresponding to the corrected fuel injection value during engine start obtained in said correcting means;

means for detecting a start time of the internal combustion engine with the fuel injection amount determined by the generated fuel injection pulse;

means for assigning a start time rank for the detected start time depending upon the length of the start time;

means for calculating a new fuel correction value during engine start based upon the assigned start time rank; and means for renewing the fuel correction value during engine start stored in the memory by incorporating the calculated new fuel correction value during engine start for use in the next engine start.

2. An electronic fuel injection eontrol device for an internal combustion engine according to claim 1, wherein the start time detected by said engine start time detecting means is further standardized by start time correction coefficients determined respectively by water temperature at engine start and by engine rotating angle until complete explosion.

3. An electronic fuel injection control device for an internal combustion engine according to claim 1, wherein the new fuel correction value for the respective start time ranks are determined by incorporating variables relating to at least two factors which influence the air/fuel ratio during engine start.

4. An electronic fuel injection control device for internal combustion engine according to claim 1, wherein the calculated new fuel correction value during engine start is modified by a correction coefficient which decreases depending upon number of correction count.

5. An electronic fuel injection control device for an internal combustion engine according to claim 1, further comprising means for determining the fuel nature used in the internal combustion engine based upon the assigned start time rank and the fuel correction value modified by incorporating the calculated new fuel correction value for use in the next engine start and the calculated fuel injection value determined by said fuel injection value calculating means is corrected after engine start based upon the result of determination by said fuel nature determining means.

6. An electronic fuel injection control device for an internal combustion engine according to claim 3, wherein the factors which influence the air/fuel ratio during engine start include flow rate of a fuel injector, clogging of a fuel injector, nature of gasoline in use and fuel leakage in a fuel injector.

7. An electronic fuel injection control device for an internal combustion engine according to claim 6, wherein the factor of the fuel leakage in a fuel injector is only included in a range of water temperatures at engine start from 50° C. to 75° C.

8. An electronic fuel injection control device for an internal combustion engine according to claim 5, wherein the determination of the fuel nature used is confirmed after a predetermined number of the same determinations and the confirmed result is used after engine start for correcting the calculated fuel injection value determined by said fuel injection value calculating means.

9. A method of an electronic fuel injection control for an internal combustion engine comprising the steps of:

detecting operating conditions of the internal combustion engine;

calculating a fuel injection value for the internal combustion engine based upon the detected operating conditions;

correcting the calculated fuel injection value by a fuel correction value during engine start which is stored in a memory;

generating a fuel injection pulse for a fuel injector corresponding to the corrected fuel injection value during engine start;

detecting a start time of the internal combustion engine started by the fuel injection determined by the generated fuel injection pulse;

assigning a start time rank for the detected start time depending upon the length of the start time;

calculating a new fuel correction value during engine start based upon the assigned start time rank; and renewing the fuel correction value during engine start stored in the memory by incorporating the calculated new fuel correction value during engine start for use in the next engine start.

* * * * *